US006349666B1

(12) United States Patent
Hastings

(10) Patent No.: US 6,349,666 B1
(45) Date of Patent: Feb. 26, 2002

(54) ARTICULATED BOAT TOP ASSEMBLY

(76) Inventor: Joseph A. Hastings, 6400 Tokeneak Tr., Mobile, AL (US) 36695

( * ) Notice: Subject to any disclaimer, the term of this patent is extended or adjusted under 35 U.S.C. 154(b) by 0 days.

(21) Appl. No.: 09/801,458

(22) Filed: Mar. 7, 2001

(51) Int. Cl.[7] ..... B63B 17/00
(52) U.S. Cl. ..... 114/361; 135/88.01
(58) Field of Search ..... 114/361; 135/88.01, 135/120.1, 120.4, 141, 155

(56) References Cited

U.S. PATENT DOCUMENTS

| | | | | |
|---|---|---|---|---|
| 3,032,046 A | | 5/1962 | Coonradt | |
| 4,562,786 A | * | 1/1986 | Pruonto | 114/361 |
| 5,016,558 A | | 5/1991 | Oehler | |
| 5,240,020 A | | 8/1993 | Byers | |
| 5,579,797 A | | 12/1996 | Rogers | |
| 5,904,114 A | * | 5/1999 | Wright | 114/361 |
| 5,918,613 A | | 7/1999 | Larson | |
| 5,931,114 A | * | 8/1999 | Bartholomew | 114/361 |
| 5,983,824 A | | 11/1999 | Hernandez | |

* cited by examiner

*Primary Examiner*—Stephen Avila
(74) *Attorney, Agent, or Firm*—Christopher A. Holland; Robert J. Veal; Burr & Forman LLP

(57) ABSTRACT

An articulated boat top assembly is attached to a conventional boat and operable to be moved between an extended position and a retracted position. The articulated boat top assembly includes a boat top that is secured to the boat via two articulated frame members. The articulated frame members include a series of skeletal components that are pivotally connected to each other. The skeletal components of the articulated boat top assembly include a base member, a pair of middle arms, and a pair of upper arms. The base member includes a pair of legs rigidly attached to the boat deck. The legs of the base member are additionally connected to each other via a stabilizing arm that reinforces the position of the frame members. The skeletal components of the articulated frame members are either in the extended position, wherein each member of the skeletal components is arranged substantially in a vertical alignment with each other, or in the retracted position, wherein each middle arm is at a substantially right angle with respect to the legs of the base member and the upper arms.

11 Claims, 14 Drawing Sheets

ARTICULATED BOAT TOP ASSEMBLY

FIELD OF THE INVENTION

The present invention relates to a articulated boat top assembly. More specifically, the present invention refers to an articulated boat top assembly that is positionable in both an extended position and a retracted position, and that may be pivoted between the extended and retracted position in a simple and quick manner such that the boat top is securely and tightly positioned in the extended position or the retracted position.

BACKGROUND OF THE INVENTION

Boat top assemblies are commonly implemented in the prior art to provide a means for supporting a boat top on a boat. Boat tops provide cover and protection for both the boat itself and also the passengers on the boat. Various styles of boat tops are commonly known in the prior art. One conventional boat top is a tee-top, which consists of a framework that is attached to the center console of the boat. The conventional tee-top assembly includes a boat top that is inflexibly secured to the top of the framework attached to the boat. Since strong wind forces are applied to the boat top and the framework when the boat is traveling, the framework must be constructed of heavy gauge aluminum or stainless steel pipe and fitted for each individual boat design, which makes such a design expensive to build since it is specifically made for each individual boat design. Moreover, standard tee-top designs tend to fracture while traveling over large waves due to the rigidity of the tee-top and the flexibility of the boat that the top is mounted to.

A further problem with custom-made tee-top designs is that they maintain a fixed position. As a result of this fixed positioning, the boat must be stored in a special housing that has ample room for the added height of the fixed tee-top. More specifically, a boat having a custom built tee-top usually cannot be stored in a standard size garage or a commercial covered marine storage facility because of the standard height of the boat cover on the framework of the tee-top design. Moreover, the tubing of this design must be large so as to be able to support a conventional electronics box that is required for communication.

In an attempt to solve these problems with tee-top assembly designs, U.S. Pat. No. 5,918,613 to Larson discloses a tee-top for boat center consoles that is detachable. This tee-top design includes a framework having a plurality of base portions of elongated pipes that are fastened to two opposed sides of a center console of a boat. An additional elongated pipe is included for each of the base portions, with the additional elongated pipe being sized and configured to be slidably receivable within an upwardly or downwardly facing opening of a respective one of the elongated base portions. Since the elongated pipes are not made of heavy duty metal, the upper section of the additional elongated pipes may be removed from the elongated base portions when it is desired to remove the detachable tee-top from the associated vessel. In a fixed position, the upper and lower elongated tubes are secured with an inner core tube held together by a pin. The additional elongated pipes support a generally horizontally oriented support frame for a cover. High-speed straps are further attached to this support frame and attached to the base portions of the inventive framework to prevent distortion of the elongated tubes or pipes at high wind speeds. The support frame is thus not subject to wind stress at high boat speeds. However, a problem with this top design is that it is not able to withstand large waves for an extended period of time, and it does not have the strength to support the conventional electronic equipment used with such boats. Another problem experienced by this design is that it must be completely disassembled to obtain the desired result, so it is difficult for the average boat operator to assemble and disassemble framework as required for this design to be helpful. More specifically, rather than collapsing, this design must be completely disassembled or detached from the boat to provide the desired result. Moreover, marine electronics cannot be plugged and removed. Consequently, this design can not only not withstand the load of the electronics, it would not allow the operator to remove the top to connect the electronics thereto What is desired, then, and not found in the prior art, is a retractable boat top assembly that is strong and rigid in both a retracted and an extended position to withstand wind forces, support electronics, and limit sway of the boat top, with the articulated boat top assembly also being easily extended or retracted by a common passenger of the boat.

SUMMARY OF THE INVENTION

An object of the present invention is to provide an articulated boat top assembly that may be rigidly and securely situated in both an extended position and a retracted position.

A further object of the present invention is to provide an articulated boat top assembly that may be pivoted between an extended position and a retracted position.

An additional object of the present invention is to provide an articulated boat top assembly that is easily pivoted between the extended position and the retracted position.

These and other objects of the invention are accomplished through the present articulated boat top assembly. The articulated boat top assembly of the present invention is designed to be securely mounted to a conventional boat having a boat deck and a console. The articulated boat top assembly includes a boat top that is secured to the boat via two articulated frame members. The articulated frame members include a series of skeletal components that are pivotable between an extended position and a retracted position. The skeletal components of the articulated boat top assembly include a base member, a pair of middle arms, and a pair of upper arms. The base member includes a pair of legs that are rigidly attached to the boat deck, although additional embodiments may allow secure connections of the legs to other elements of the boat. The legs of the base member are additionally connected to each other via a stabilizing arm, such that the stabilizing arm will reinforce the position of the frame members. Additionally, the position of each articulated frame member may be securely maintained by a locking rod or a torsion bar. As a result, the boat top will be securely positioned to withstand wind forces in either the extended or retracted position such that sway in any direction is minimized or eliminated during travel of the boat. In the extended position, each member of the skeletal components is arranged substantially in a vertical alignment with each other such that the boat top is in the uppermost vertical position. In the retracted position, each middle arm is at a substantially right angle with respect to the legs of the base member and the upper arms such that the boat top is in the lowermost vertical position.

In addition to the locking bar and torsion bar, a series of sleeves may also be included to reinforce the position of the articulated boat top assembly when it is in the extended position and while the torsion bars are being attached. The sleeves are positioned around the middle arms of the articulated boat top assembly such that the sleeves may slide along the periphery of the middle arms. In operation, when the articulated frame members are in the extended position such that the skeletal components are substantially in line, the sleeves may be moved to surround the articulated junction between the middle arms and the base member and upper arms.

These and other objects and advantages of the invention will become apparent from the following detailed description of the preferred embodiment of the invention

BRIEF DESCRIPTION OF THE DRAWINGS

An articulated boat top assembly embodying the features of the present invention is depicted in the accompanying drawings which form a portion of this disclosure and wherein.

DESCRIPTION OF THE PREFERRED EMBODIMENTS

Figure 1:
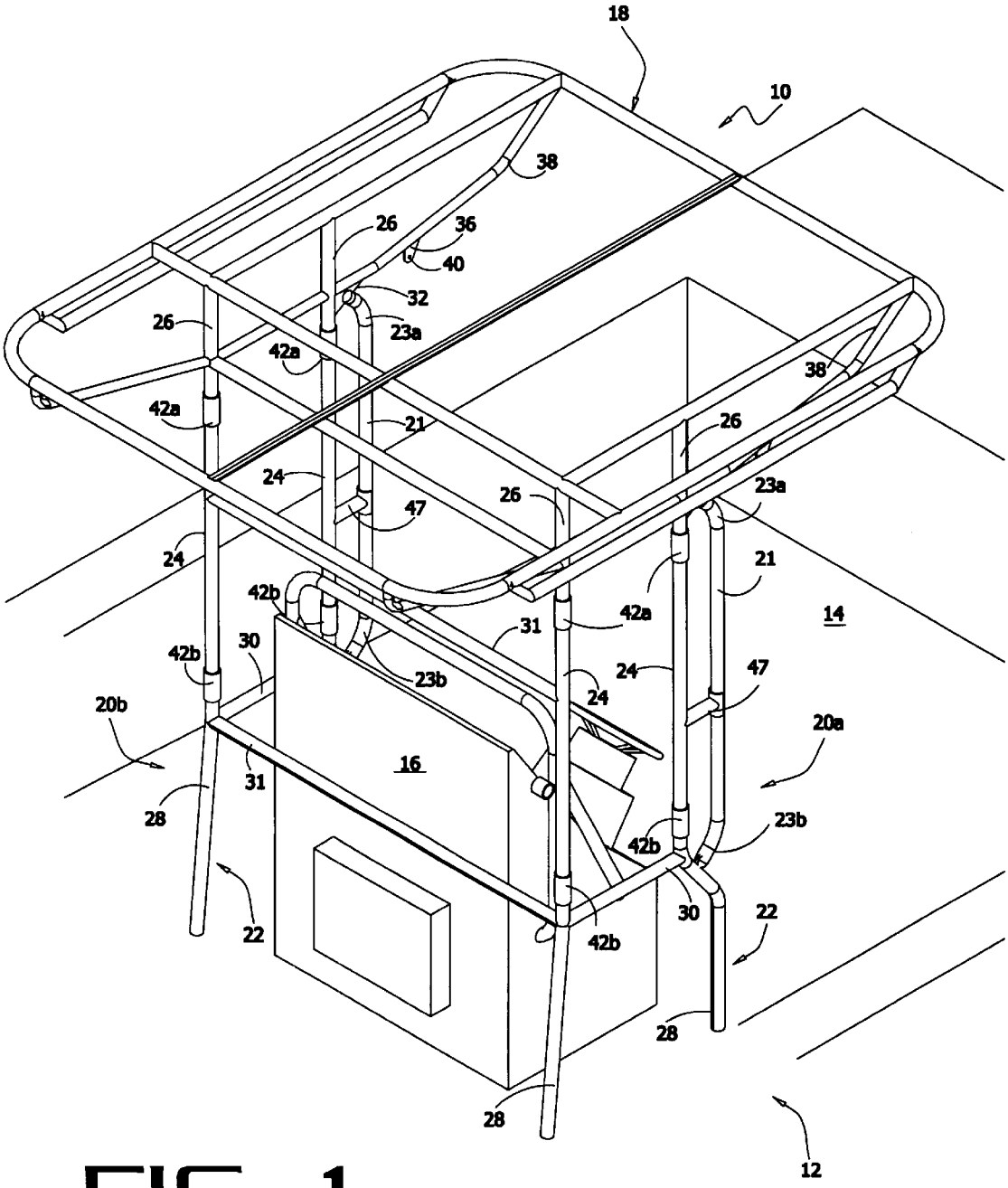
FIG. 1 is a perspective view of a first embodiment of an articulated boat top assembly of the present invention positioned around a conventional console of a boat.

Referring now to FIG. 1, a first embodiment of the articulated boat top assembly 10 of the present invention is illustrated as attached to a conventional boat 12 having a boat deck 14 and a console 16. The articulated boat top assembly 10 includes a boat top 18 that is secured to the boat 12 via two articulated frame members 20*a*, 20*b*. The articulated frame members 20*a*, 20*b* include a series of skeletal components that are pivotable between an extended position (see FIG. 2) and a retracted position (see FIG. 3). Additionally, in the first embodiment, a torsion bar 21 is attached to each articulated frame member 20*a*, 20*b* to maintain the position of the articulated frame member 20*a*, 20*b* in either the extended or retracted position. Moreover, a pair of stabilizing shafts 31 are provided to connect the articulated fame members 20*a*, 20*b* to each other and provide a stable assembly 10. Consequently, the boat top 18 is sturdily positioned in either the extended or retracted position such that sway in any direction is minimized or eliminated during travel of the boat 12.

Figure 4:
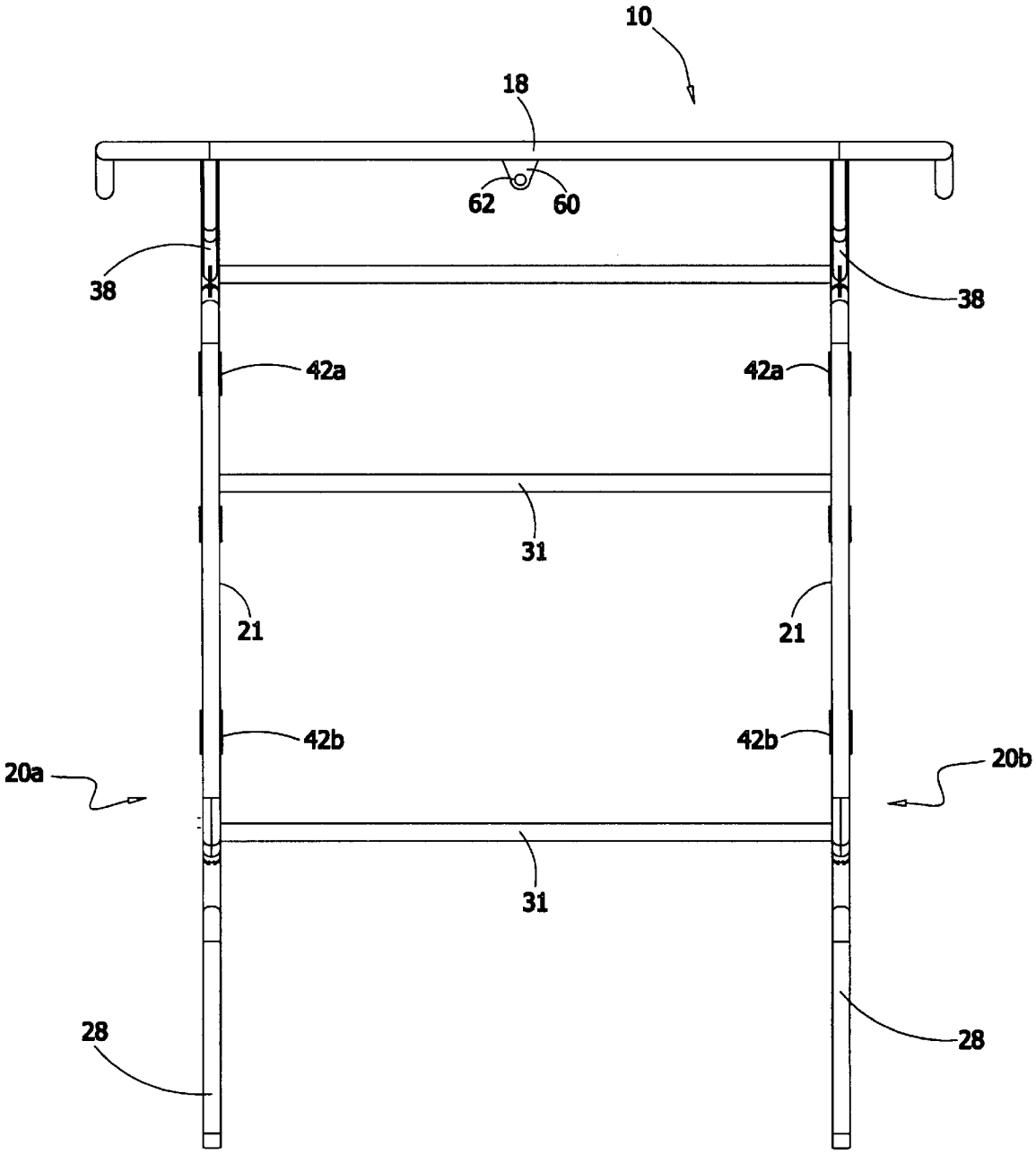
FIG. 4 is a side elevational view of the articulated boat top assembly illustrated in FIG. 1, with the assembly being shown in the extended position.

Looking at the side view of FIG. 4, the skeletal components of the articulated frame members 20*a*, 20*b* are clearly illustrated. The skeletal components of each articulated frame member 20*a*, 20*b* in the preferred embodiment include a base member 22, a pair of middle arms 24, and a pair of upper arms 26. The base member 22 includes a pair of legs 28 that are rigidly attached to the boat deck 14 (see FIG. 1), although additional embodiments may allow secure connections of the legs 28 to other elements of the boat 12 as well (such as the console 16). The base member 22 additionally includes a base stabilizing rod 30 that connects the legs 28 of the base member 22 to strengthen and reinforce the posture of the frame members 20*a*, 20*b*. Continuing to view FIG. 4, each middle arm 24 has a senior end 25*a* and a junior end 25*b*, with the junior end 25*b* pivotally connected to one leg 28 of the base member 22 and the senior end 25*a* pivotally connected to one upper arm 26, with the opposing end of the upper arm 26 being rigidly connected to the boat top 18. Looking at FIG. 7, the junction between each middle arm 24 and the respective leg 28 or upper arm 26 is made by a pin 29, although any similar type of connection may be implemented as desired by the manufacturer.

Figure 9:
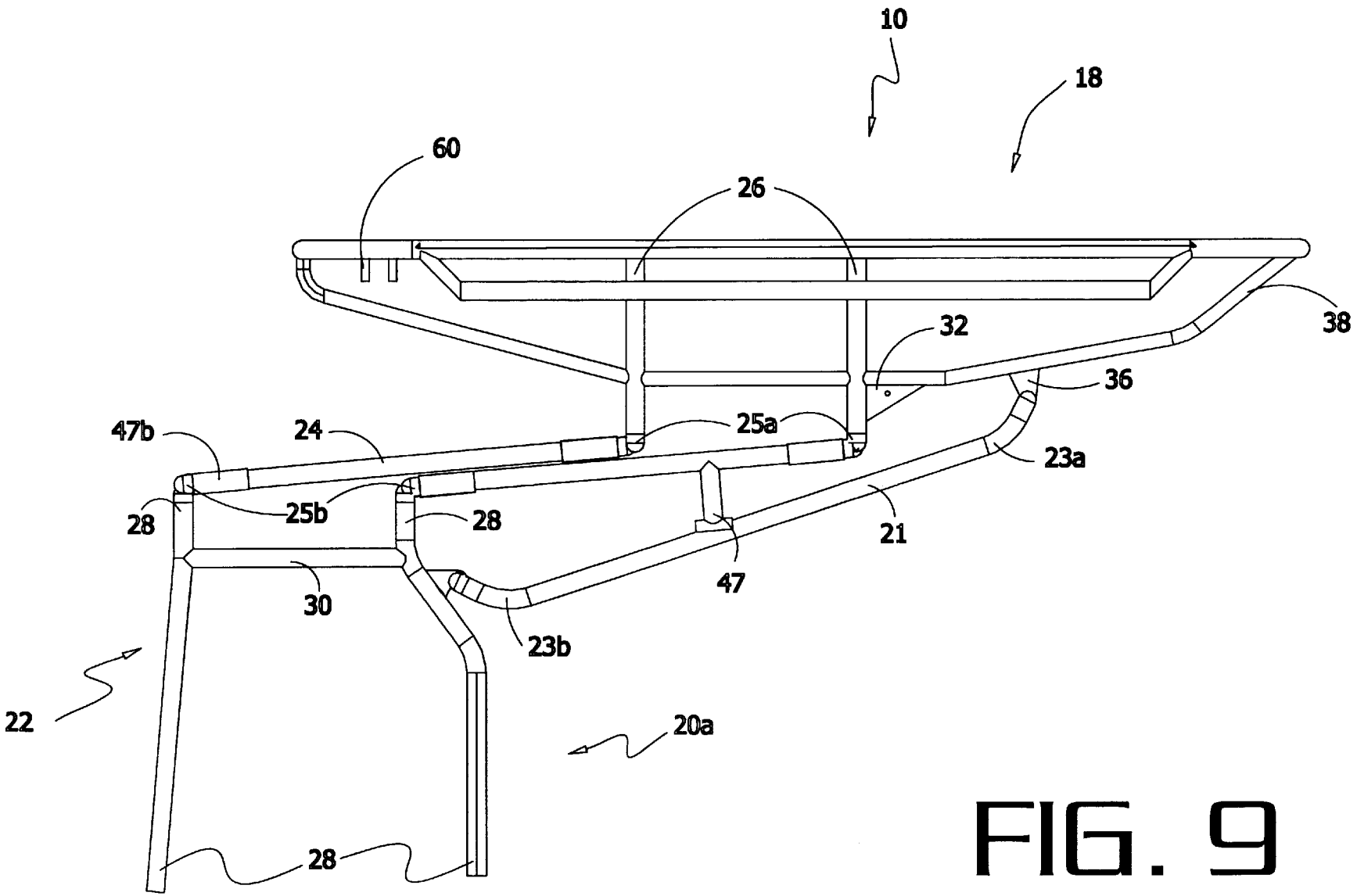
FIG. 9 is a side elevational view of the articulated boat top assembly illustrated in FIG. 1, with the assembly being shown in the retracted position.

As stated above, the skeletal components of the articulated frame members 20*a*, 20*b* are designed such that the articulated frame members 20*a*, 20*b* can be pivoted between an extended position (shown in FIG. 2) and a retracted position (shown in FIG. 3), with the boat top 18 remaining parallel to the boat 12 during the positioning. Looking at the extended position shown in FIG. 2, the legs 28 of the base member 22, the middle arms 24, and the upper arms 26 are each arranged to be in a substantially vertical and parallel alignment with each other such that the boat top 14 is in the uppermost vertical position. In the retracted position illustrated in FIGS. 3 and 9, each middle arm 24 is at a substantially right angle with respect to the legs 28 of the base member 22 and the upper arms 26 such that the boat top 14 is in its lowermost vertical position. The height of the boat top 18 in the retracted position is further determined by the length of the base legs 22 and the upper arms 26 plus the thickness of the pipe used to form the various skeletal components.

Figure 2:
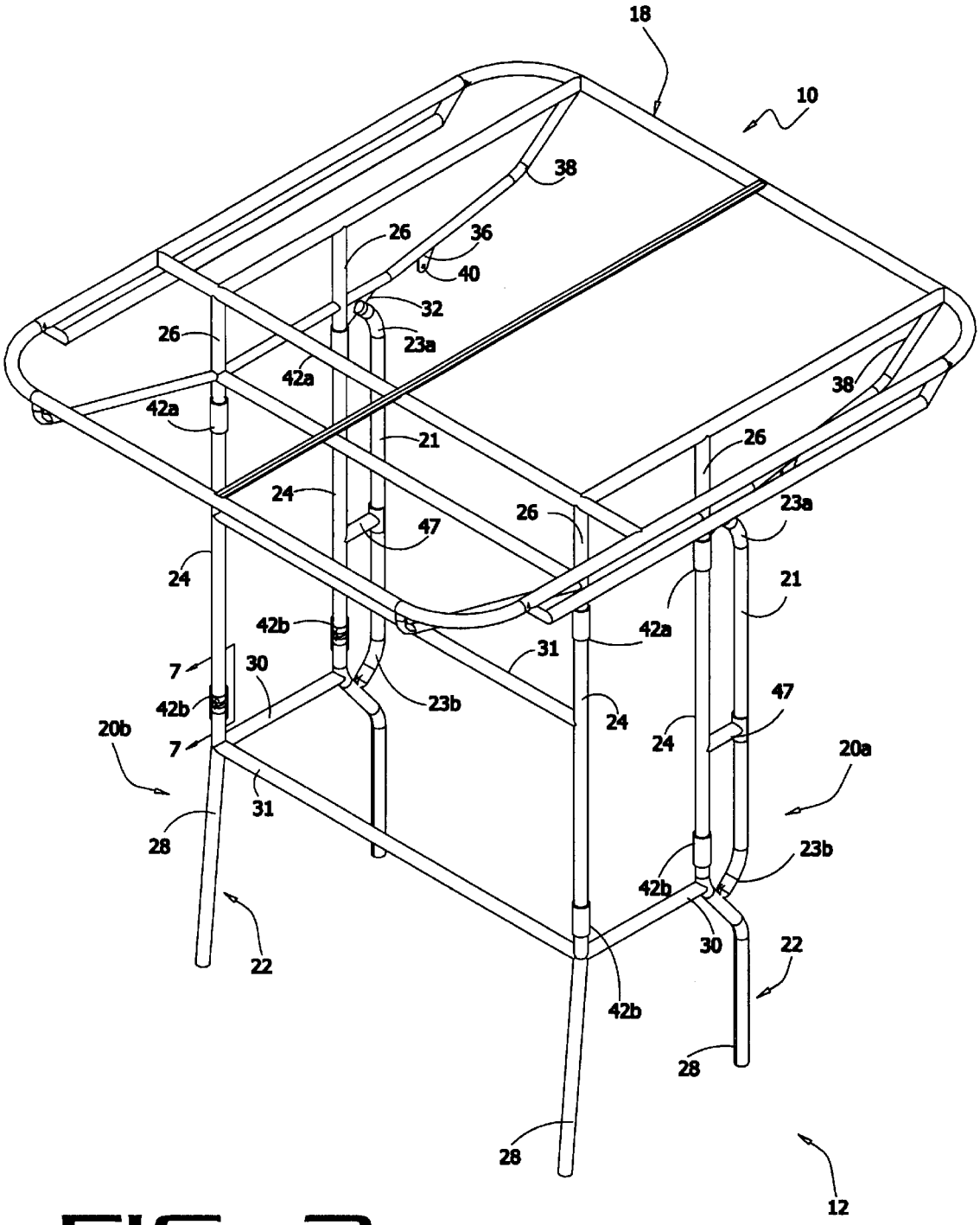
FIG. 2 is a perspective view of the articulated boat top assembly as illustrated in FIG. 1, with the assembly being shown in an extended position.
Figure 3:
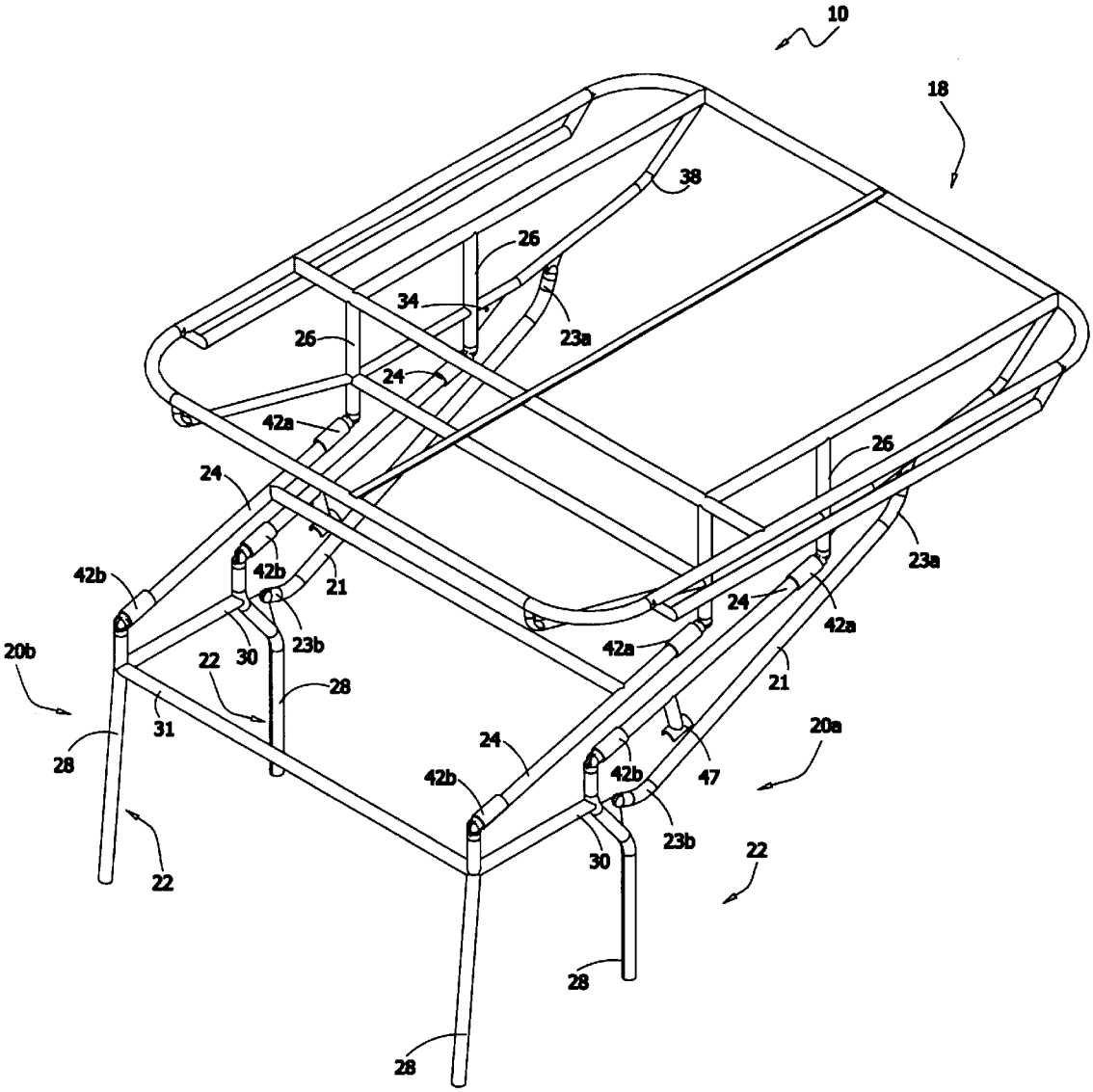
FIG. 3 is a perspective view of the articulated boat top assembly illustrated in FIG. 1, with the assembly being shown in a retracted position.
Figure 5:
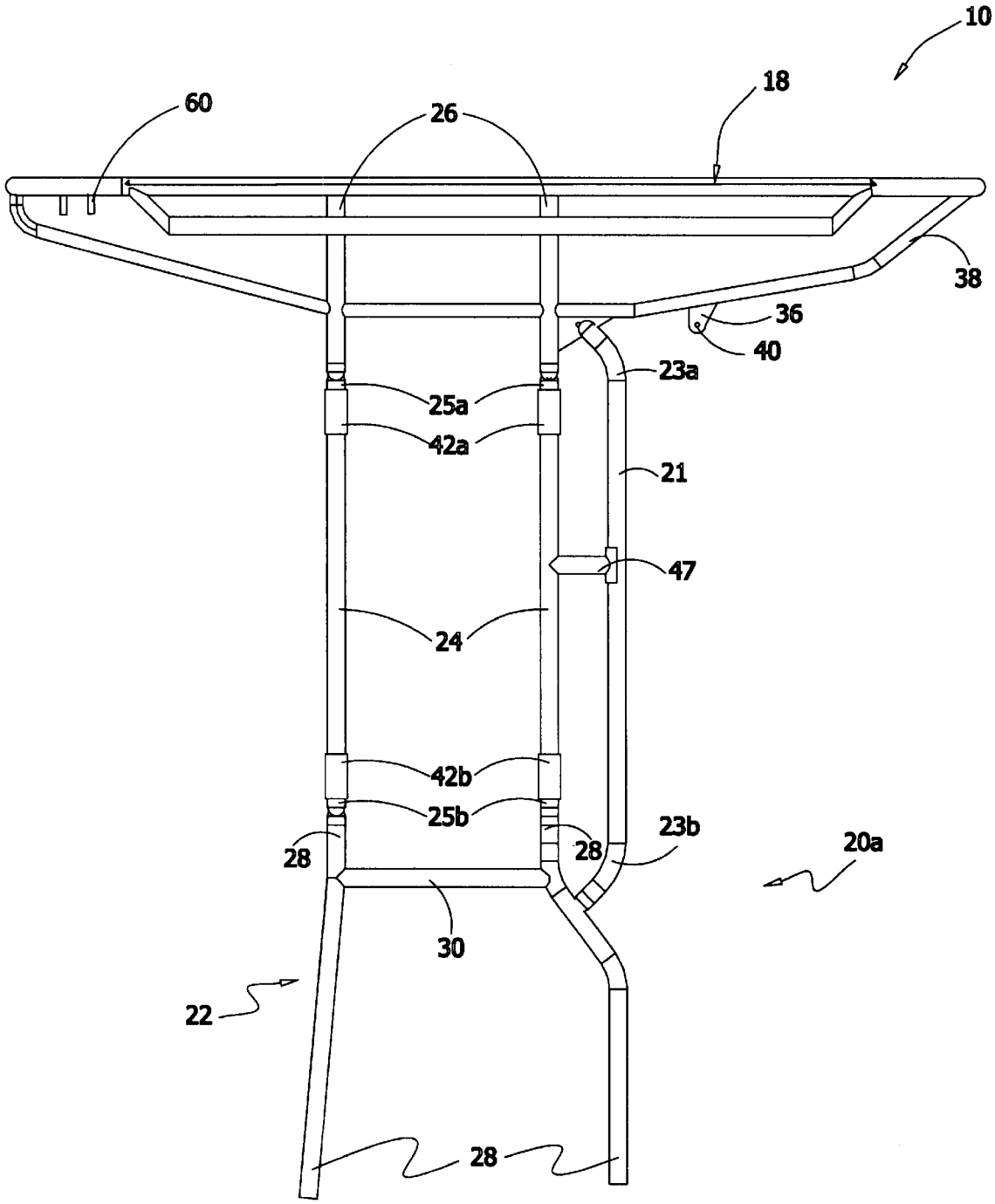
FIG. 5 is a front elevational view of the articulated boat top assembly illustrated in FIG. 1, with the assembly being shown in the extended position.
Figure 6:
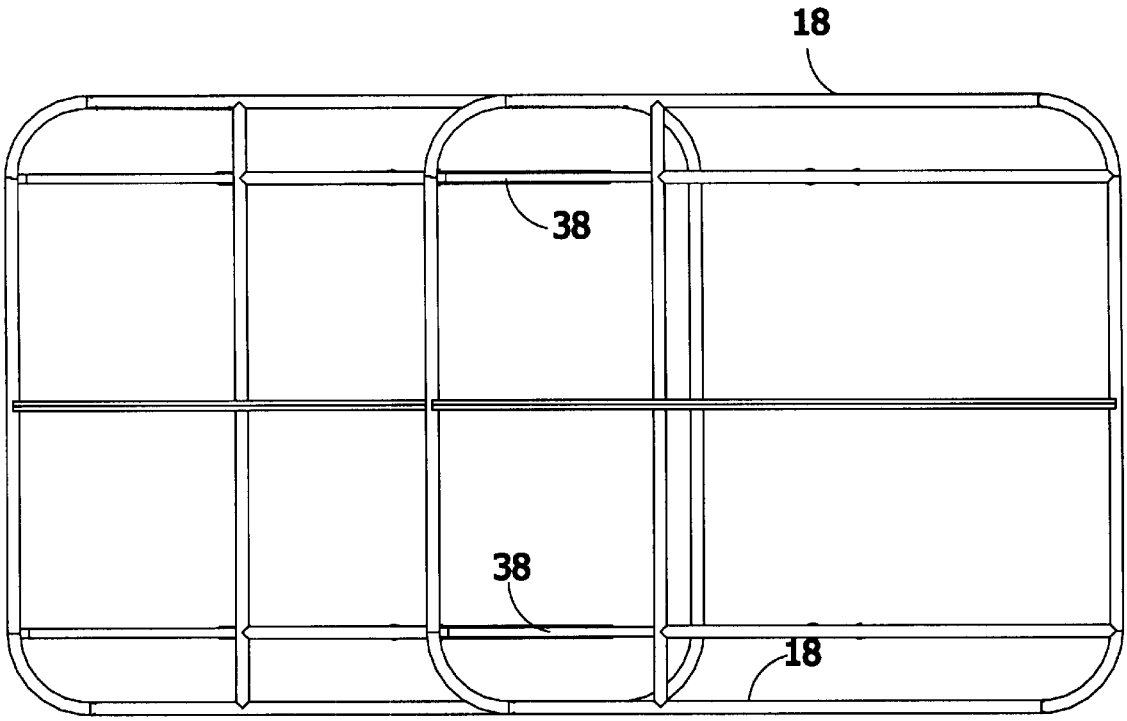
FIG. 6 is a top plan view of the articulated boat top assembly illustrated in FIG. 1.

Continuing to view FIG. 2, the torsion bar 21 of the first embodiment is pivotally attached to each articulated frame member 20*a,* 20*b* to secure the articulated frame members 20*a,* 20*b* in their extended position, and to further reduce the opportunity for any undesired movement or sway. The torsion bar 21 has an upper end 23*a* and a lower end 23*b,* with the lower end 23*b* being connected to the frame member 20*a*. The upper end 23*a* of the torsion bar 21 is designed to be coupled with one of several locking tabs that are included in the articulated boat top assembly 10. As most clearly viewed in FIG. 4, an extension locking tab 32 is mounted to each upper arm 26. The extension locking tab 32 defines an extension locking aperture 34 (see FIG. 3) that traverses the extension locking tab 32 such that the upper end 23*a* of the torsion bar 21 can be coupled to the extension locking tab 32 using a conventional pin 35. Therefore, due to the rigidity of the torsion bar 21, the skeletal components of the articulated frame members 20*a,* 20*b* will be maintained in a substantially vertical alignment. Conversely, looking at FIGS. 2 and 4, a boat top support beam 38 is mounted to the boat top 18, with a retraction locking tab 36 mounted to the boat top support beam 38. As with the extension locking tab 32, the retraction locking tab 36 defines a retraction locking aperture 40 that traverses the retraction locking tab 36 such that the upper end 23*a* of the torsion bar 21 can be coupled to the retraction locking tab 36 using the pin 35 when the articulated frame members 20*a,* 20*b* are in the retracted position. Therefore, when the skeletal components of the articulated frame members 20*a,* 20*b* are in either the extended or retracted position, the rigidity of the torsion bar 21 will secure the articulated frame members 20*a,* 20*b* in that position. The torsion bar 21 therefore adds additional strength when the extended or retracted position to withstand the forces on the assembly during travel. Additionally, a locking clevis 60 (see FIGS. 4 and 5) may additionally be connected to the boat top support beam 38 such that it will engage and lock with the console 12 when the articulated frame members 20*a,* 20*b* are in the retracted position.

In addition to the torsion bar 21, a series of sleeves 42*a,* 42*b* may also be included in the preferred embodiment to reinforce the stability of the articulated boat top assembly 10 when it is in the extended position (see FIG. 1) and while the torsion bar 21 is being attached to the articulated frame members 20*a,* 20*b*. Each set of sleeves 42*a,* 42*b* includes an upper sleeve 42*a* and a lower sleeve 42*b* that are positioned around each middle arm 24 of the articulated boat top assembly 10 when unlocked (see FIG. 2). Both sleeves 42*a,* 42*b* are able to slide along the periphery of the middle arms 24. Preferably, each pair of sleeves 42*a,* 42*b* is designed such that the upper sleeve 42*a* may be positioned proximate the junction of the upper arm 26 and the middle arm 24, and the lower sleeve 42*b* may be positioned proximate the junction of the base member 22 and the middle arm 24, to lock the frame members 20*a,* 20*b* in the extended position. In operation, when the articulated frame members 20*a,* 20*b* are in the extended position such that the skeletal components are substantially in line, the sleeves 42*a,* 42*b* may be moved to surround the articulated junction between the middle arms 24 and the legs 28 of the base member 22, and also at the articulated junction between the middle arms 24 and the upper arms 26 (see FIG. 7). Both sleeves 42*a,* 42*b* are preferably made of a strong and rigid material, such as steel, although various materials, such as aluminum, may be used as well. The sleeves 42*a,* 42*b* will therefore help to prevent any pivoting movement at the articulated junction between the middle arm 24 and either the base member 22 or the upper arm 26, which will securely maintain the substantially vertical position of the articulated frame members 20*a,* 20*b*.

Figures 7, 8:
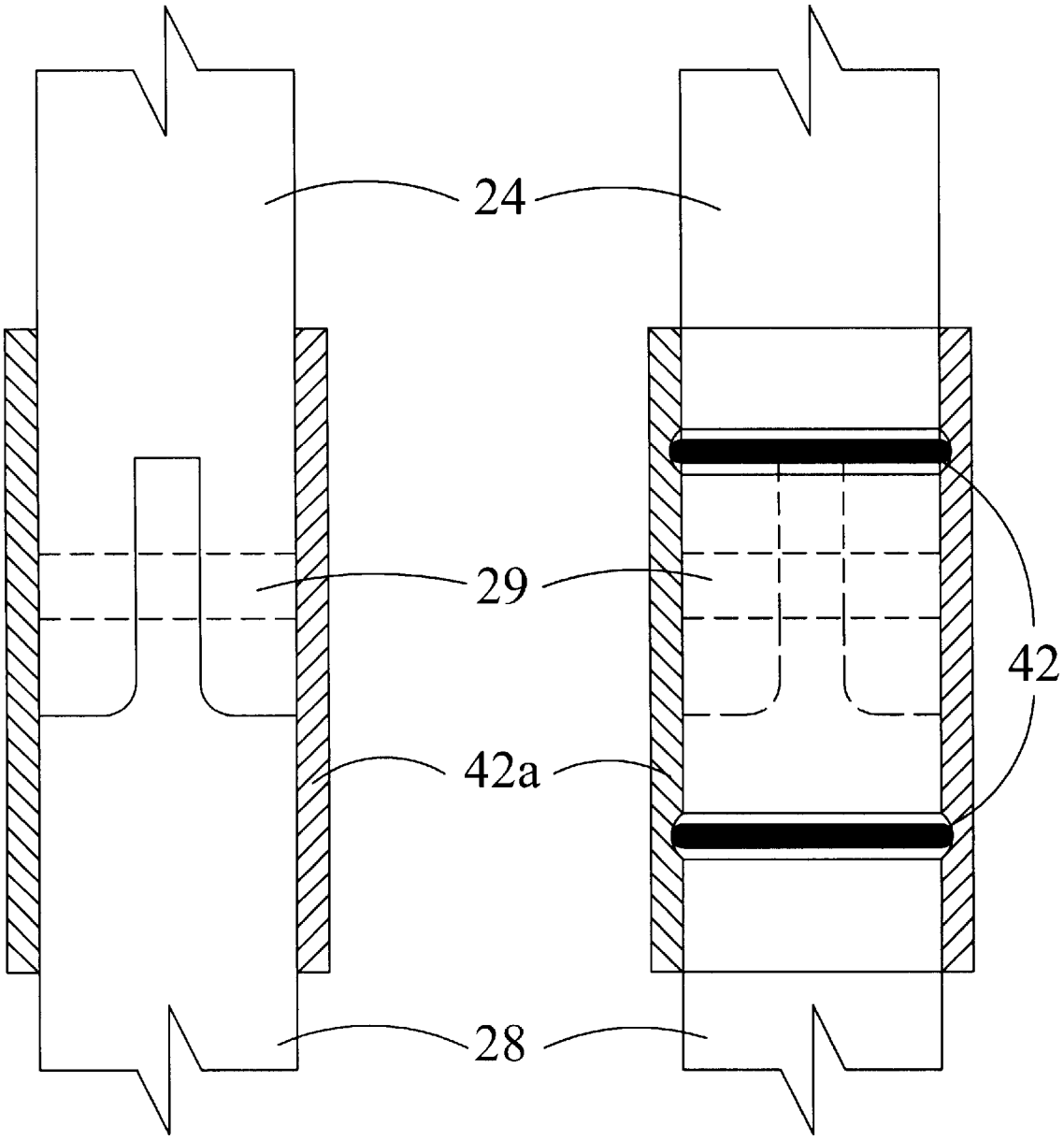
FIG. 7 is a sectional view of the connection between a middle arm and a leg of a base member of the articulated boat top assembly of the present invention, the view taken along lines 7—7 of FIG. 2.
FIG. 8 is a partial perspective view of the junction between the a middle arm and a leg as used in the present invention including a pair of gaskets used to secure the position of the sleeve on the middle arm and the leg, and additionally including a sectional view of the sleeve.

Additionally, looking at the cross-sectional view of the sleeve 42*a,* 42*b* illustrated in FIG. 8, the present invention may additionally include a pair of gaskets 46 that are positioned between the sleeve 42*a* and the middle arm 24, base member 22, or upper arm 26. The gaskets 46 are mounted between each sleeve 42*a,* 42*b* and the middle arm 24 such that the gaskets 46 will prevent the sleeves 42*a,* 42*b* from freely sliding along the middle arm 24. The gaskets 46 allow the sleeves 42*a,* 42*b* to stay in their desired position without being drilled and pinned.

Referring back to FIGS. 2 and 3, a brace 47 is additionally included to create a torsion effect between base members 22 and upper arms 26. The brace 47 is attached to the middle arm 24 and extends away from the middle arm 24 toward the torsion bar 21 such that the brace 47 will engage the torsion bar 21 when the articulated boat top assembly 10 is in the extended position. The brace 47 is preferably made of a strong and rigid material, such as steel, such that when the torsion bar 21 engages the brace 47, the brace 47 will reinforce the locked position of articulated boat top assembly 10. In addition, a coating (not illustrated) is applied to the surfaces of the brace 47 and the middle arms 24 that make contact with each other in order to reduce any damage that may occur due to their contact with each other.

In operation, to reposition the articulated boat top assembly 10 from the extended position (see FIG. 2) to the retracted position (see FIG. 3), the user will first loosen the upper and lower sleeves 42*a,* 42*b*. The user will then slide them away from the articulated junctions between middle arms 24 and both the upper arms 26 and the base members 22 respectively, which will allow the middle arms 24 to pivot with respect to the upper arms 26 and base members 22. The user will then remove each pin 35 from the extension locking tab 32 to allow the torsion bar 21 to disconnect from the extension locking tab 32. Once the torsion bars 21 have been disconnected, each articulated frame member 20*a,* 20*b* can then be repositioned by the user. The middle arms 24 may be pivoted either forward or rearward as desired by the user, with the preferred embodiment directing the user to pull the articulated boat top assembly 10 such that the boat top 18 lowers in the rearward direction. As stated above, the middle arms 24 will pivot with respect to the upper arms 26 and the base members 22 in opposite directions such that the middle arms 24 will pivot to substantially right angles with respect to both the upper arms 26 and the base members 22. The boat top 18 will therefore be lowered as desired by the user during this pivoting movement. The torsion bars 21 may then be joined with to the retraction locking tab 36 using pin 35 such that each articulated frame member 20*a,* 20*b* is locked in the retracted position. In addition, the locking clevis 60 may engage the console 16 such that a pin may engage the locking clevis 60 to further secure the articulated frame members 20*a,* 20*b* in the retracted position. For the user to reposition the articulated frame members 20*a,* 20*b* in the extended position, the user will simply need to follow the above steps in the reverse order to obtain a secure rigid boat top assembly 10 in the extended position.

Figure 10:
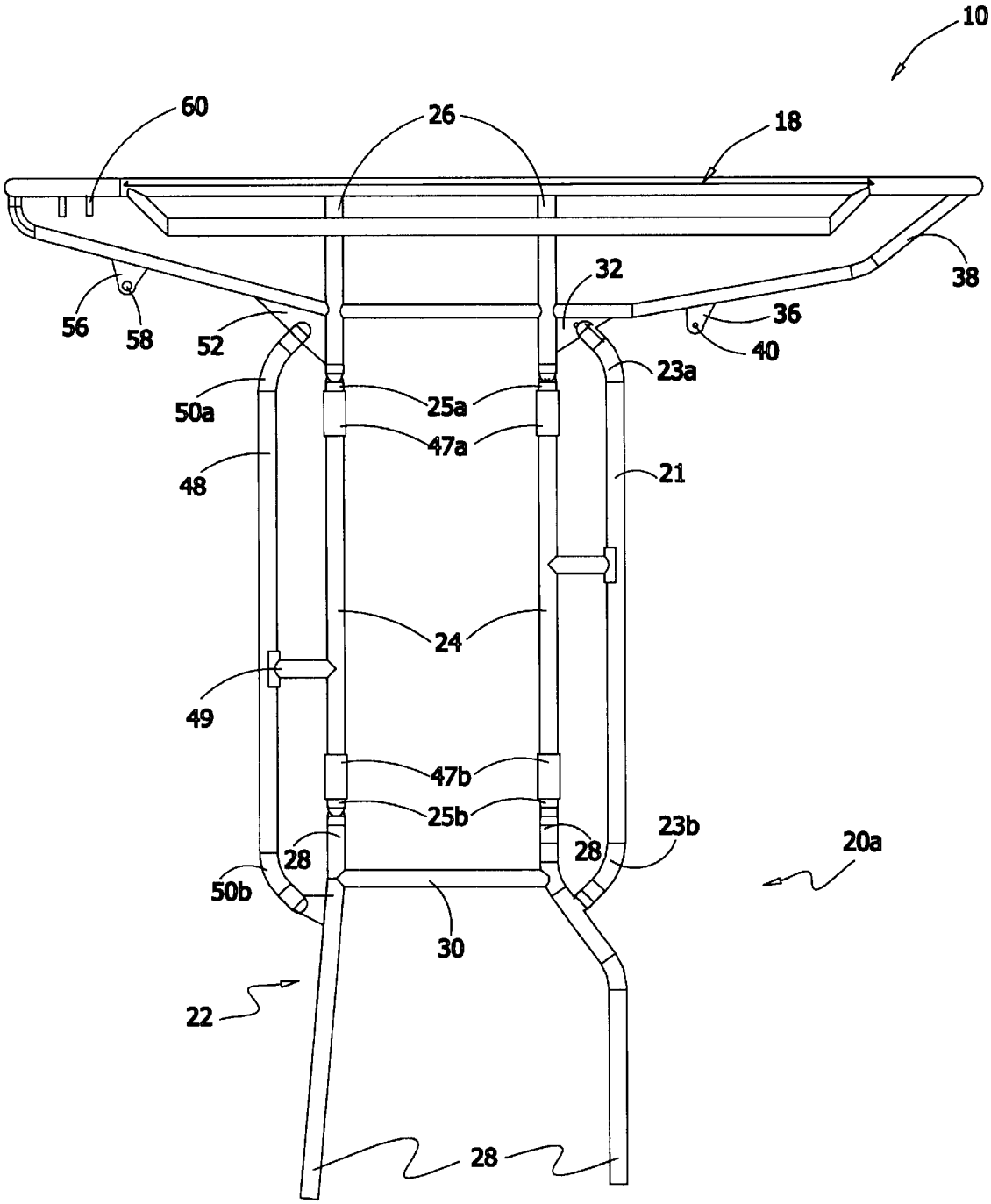
FIG. 10 is a side elevational view of the articulated boat top assembly illustrated in FIG. 1, with the assembly being shown having an auxiliary torsion bar.

Looking to FIG. 10, an auxiliary torsion bar 48 may additionally be included in the articulated boat top assembly 10. The auxiliary torsion bar 48, which is similar to the torsion bar 21, is used to further secure and lock the articulated boat top assembly 10 in either the extended or retracted position. The auxiliary torsion bar 48 has an upper end 50*a* and a lower end 50*b*, with the lower end 50*b* being pivotally connected to the frame member 20*a*. The upper end 50*a* of the auxiliary torsion bar 48 is designed to couple with one of several auxiliary locking tabs that are included in the articulated boat top assembly 10. An auxiliary extension locking tab 52 is mounted to each upper arm 26. Preferably, the auxiliary extension locking tab 52 defines an auxiliary extension locking aperture (not illustrated) that traverses the auxiliary extension locking tab 52 such that the upper end 50*a* of the auxiliary torsion bar 48 can be coupled to the extension locking tab 52 using a conventional pin (not illustrated). Therefore, due to the rigidity of the auxiliary torsion bar 48, the skeletal components of the articulated frame members 20*a*, 20*b* are maintained in a substantially vertical alignment. Conversely, an auxiliary retraction locking tab 56 is attached the boat top support beam 38. As with the auxiliary extension locking tab 52, the auxiliary retraction locking tab 56 defines a auxiliary retraction locking aperture 58 that traverses the auxiliary retraction locking tab 56 such that the upper end 50*a* of the auxiliary torsion bar 48 can be coupled to the auxiliary retraction locking tab 56 using a pin (not illustrated). Therefore, when the skeletal components of the articulated frame members 20*a*, 20*b* are in the retracted position described above, the auxiliary torsion bar 48 will secure that position due to the rigidity of the auxiliary torsion bar 48.

Figure 11:
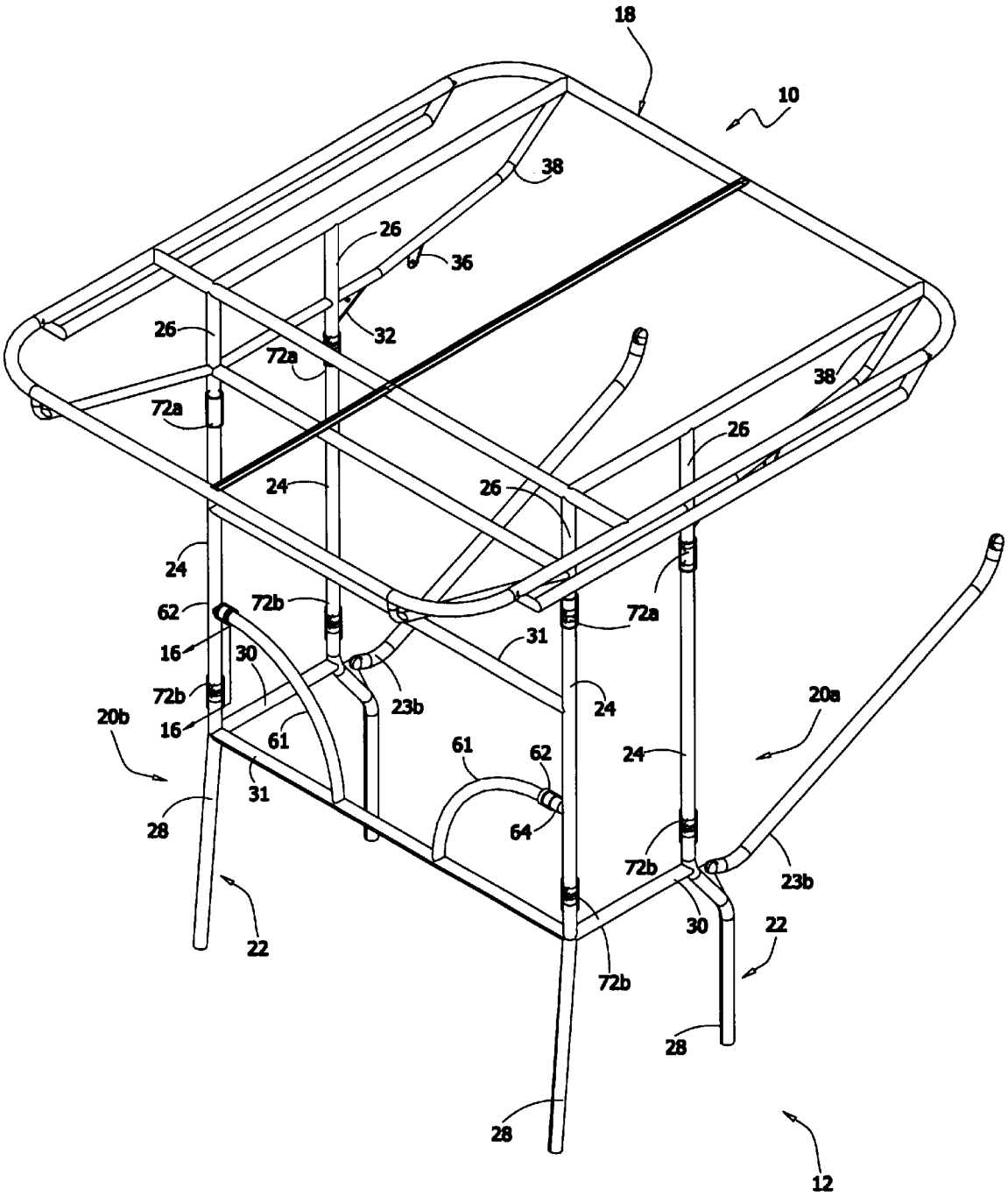
FIG. 11 is a perspective view of a second embodiment of the articulated boat top assembly having a pair of locking rods, the articulated boat top assembly being in an elevated position.
Figure 12:
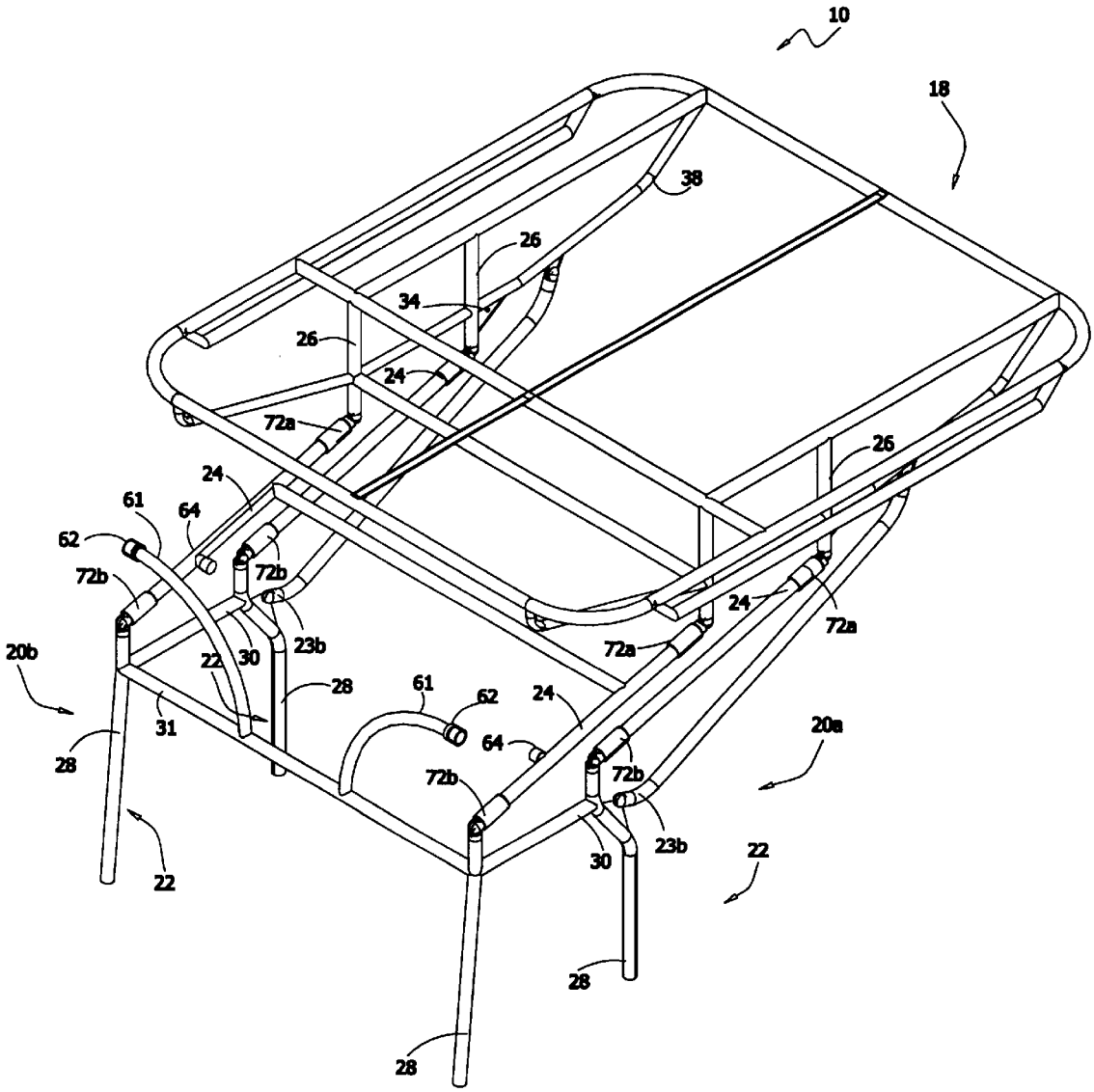
FIG. 12 is a perspective view of the second embodiment of the articulated boat top assembly having a pair of locking rods, the articulated boat top assembly being in a retracted position.
Figure 13:
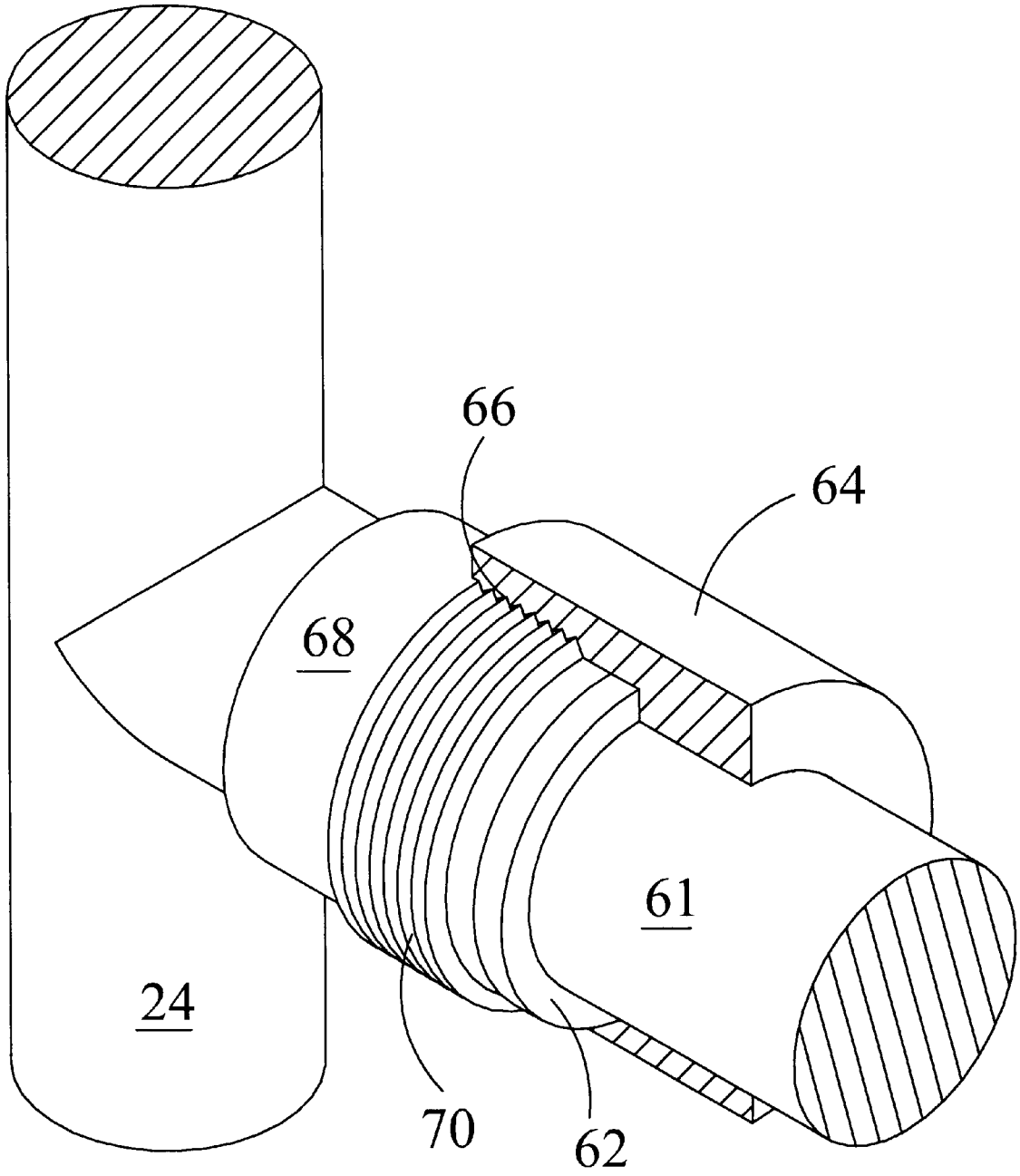
FIG. 13 is an elevational end view of the second embodiment of the articulated boat top assembly having a pair of locking rods.
Figure 15:
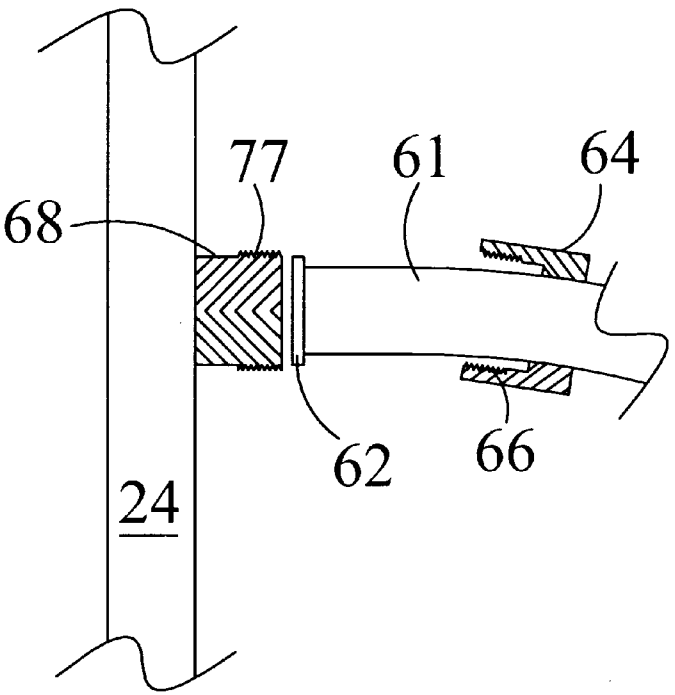
FIG. 15 is a side elevational view of the locking rod as illustrated in FIG. 15, with the locking rod unconnected to the receiving knob.
Figure 14:
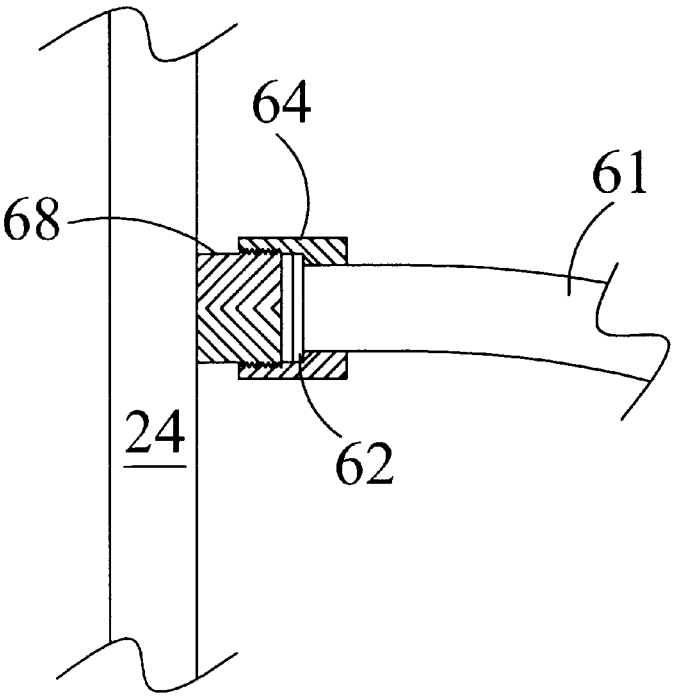
FIG. 14 is a side elevational view of a locking rod of the second embodiment of the present invention, the locking rod being connected to a receiving knob.

In a second embodiment of the articulated boat top assembly 10 illustrated in FIGS. 11 through 16, the torsion bars 21 are not used to secure the articulated frame members 20*a*, 20*b* in the extended position. Rather, a pair of locking bars 61 are operable to connect the middle arms 24 with the stabilizing shafts 31. Each locking bar 61 is preferably arcuate, and includes a disc 62 attached to one end of the locking bar 61. Looking additionally to FIGS. 14 and 15, a collar 64 is positioned around each locking bar 61, with the collar 64 being slidable along the length of the locking bar 60 in the direction identified by line A—A. The collar 64 has a threaded central surface 66, and the collar 64 is used to join the locking bars 61 with a connecting cylinder 68 attached to the middle arms 24. The connecting cylinder 68 extends from the middle arms 24, with the unattached end of the connecting cylinder 68 having a thread 70 to engage the threaded central surface 66 of the collar 64. When the articulated boat top assembly 10 is in the extended position (as shown in FIG. 11), the connecting cylinder 68 will be positioned close to the disc 62 of the locking bar 61, with a small gap separating the two elements. The collar 64 may then be moved along the locking bar 61 toward the disc 62 to engage the connecting cylinder 68. Looking at FIG. 13, the collar 64 may be screwed onto the connecting cylinder 68 to provide a resolute connection between the two elements and further secure the extended position of the articulated boat top assembly 10. The user will be able to unscrew the collar 64 when the articulated boat top assembly 10 is to be repositioned to the retracted position (see FIG. 12).

A hand bar 69 is included in this embodiment such that the hand bar 69 will secure the articulated boat top assembly 10 when in the retracted position. The hand bar 69 is pivotally connected to leg 28, such that hand bar 69 can be connected to the retraction locking tab 36. Consequently, the articulated boat top assembly 10 will be secured in the retracted position in addition to the extended position.

Figure 16:
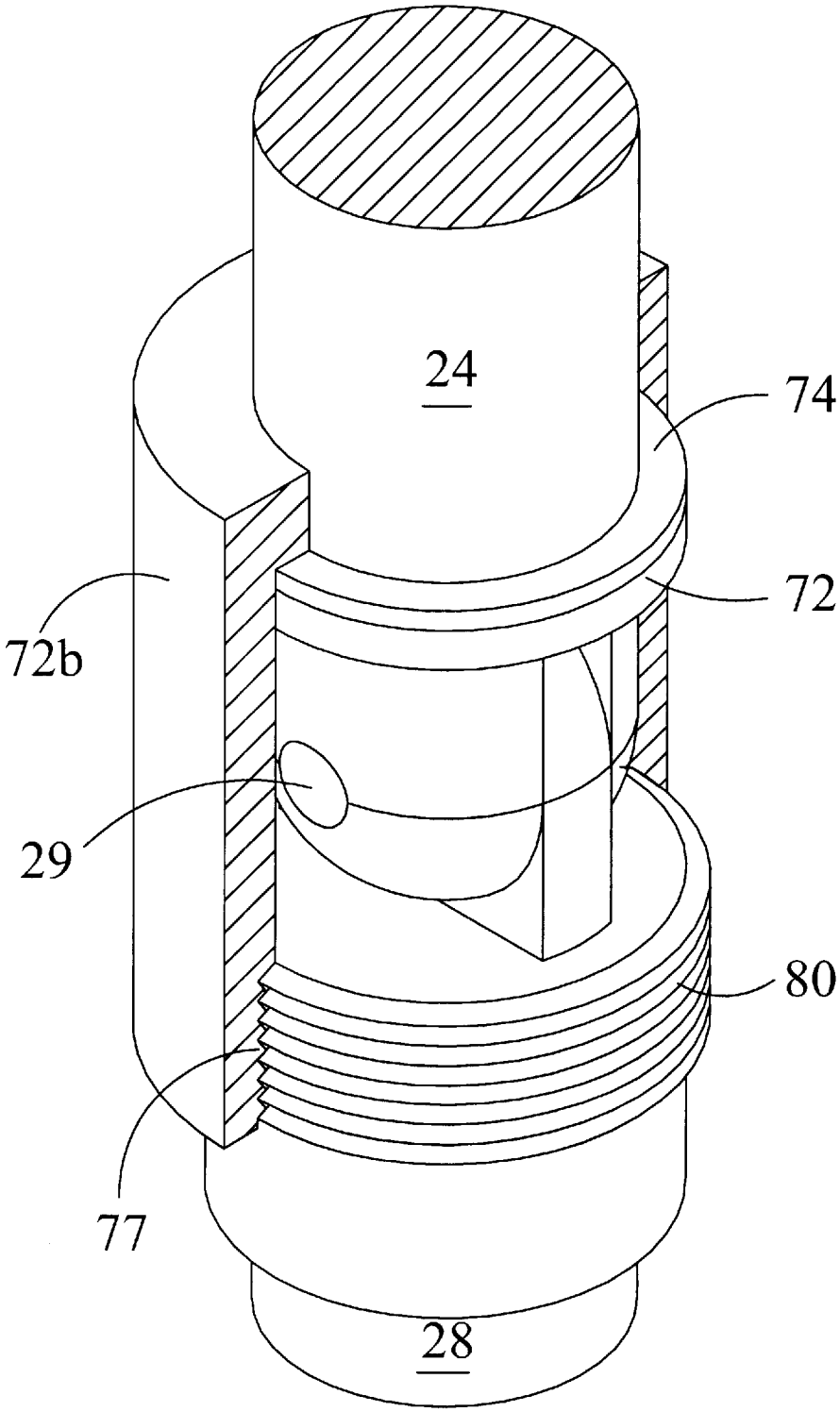
FIG. 16 is a perspective view of the lock assembly of the second embodiment of the articulated boat top assembly, the lock assembly including a threaded cylinder and a sleeve surrounding said locking bar.

Looking at FIG. 16, a sectional view of a second embodiment for the sleeves 72*a*, 72*b* is illustrated. In this embodiment, a flange 74 surrounds one end of the middle arm 24, with a ring 76 positioned proximate the flange 74. The sleeves 72*a*, 72*b* of this embodiment slidably surround the middle arm 24 and have a threaded inner surface 77. Additionally, a threaded exterior surface 80 is provided for each leg 28, such that the threaded inner surface 77 of the sleeves 72*a*, 72*b* will engage threaded exterior surface 77 of the leg 28 to securely position the sleeves 72*a*, 72*b*. The ring 76 is preferably made of neoprene to prevent undesired pitting between the sleeve 72*a*,72*b* and the middle arm 24.

Thus, although there have been described particular embodiments of the present invention of a new and useful ARTICULATED BOAT TOP ASSEMBLY, it is not intended that such references be construed as limitations upon the scope of this invention except as set forth in the following claims.

What is claimed is:

1. An articulated boat top assembly mounted to a deck of a boat, said articulated boat top assembly comprising:

a first articulated frame member including a base member;

at least one middle arm having a first and second end, said second end of said middle arm pivotally attached to said base member; and at least one upper arm having a first and second end, said second end of said upper arm pivotally connected to said first end of said middle arm;

a boat top attached to said first end of said upper arm;

a second articulated frame member including a base member;

at least one middle arm having a first and second end, said second end of said middle arm pivotally attached to said base member; and at least one upper arm having a first and second end, said second end of said upper arm pivotally connected to said first end of said middle arm;

a boat top attached to said first end of said upper arm;

wherein both said first articulated frame member and said second articulated frame member are pivotable between an extended position wherein each said middle arm is substantially in line with each said base member and each said upper arm, and a retracted position wherein each said middle arm is substantially perpendicular with respect to each said base member and each said upper arm.

2. The articulated boat top assembly as described in claim 1 wherein each said base member comprises:

a first and second leg; and a base stabilizing rod connected between said first leg and said second leg.

3. The articulated boat top assembly as described in claim 1 further comprising:

a stabilizing shaft connecting said first articulated frame member with said second articulated frame member;

a first locking bar having an upper end and a lower end, said lower end of said first locking bar connected to said stabilizing shaft;

a second locking bar having an upper end and a lower end, said lower end of said second locking bar connected to said stabilizing shaft;

a first connecting cylinder extending from said middle arm of said first articulated frame member;

a second connecting cylinder extending from said middle arm of said second articulated frame member;

a first collar movably positioned around said first locking bar, said first collar connecting said first locking bar with said first connecting cylinder; and a second collar movably positioned around said second locking bar, said second collar connecting said second locking bar with said second connecting cylinder.

4. The articulated boat top assembly as described in claim 2 further comprising at least one sleeve surrounding each said middle arm, wherein said sleeve is positionable between an unlocked position solely around said middle arm, and a locked position at least partially surrounding both said middle arm and one said leg of said base member.

5. The articulated boat top assembly as described in claim 4 further comprising at least one gasket positioned between each said sleeve and each said corresponding middle arm.

6. A multi-positionable boat top assembly attached to a boat having a deck and a console, said multi-positionable boat top assembly comprising:

a first articulated frame member mounted to the deck, said first articulated frame member including:

a base member attached to the deck of the boat;

at least one middle arm having an upper and a lower end, said lower end of said middle arm pivotally attached to said base member; and at least one upper arm having an upper and a lower end, said lower end of said upper arm pivotally attached to said upper end of said middle arm;

a second articulated frame member mounted to the deck, said second articulated frame member including:

a base member attached to the deck of the boat;

at least one middle arm having an upper and a lower end, said lower end of said middle arm pivotally attached to said base member; and at least one upper arm having an upper and a lower end, said lower end of said upper arm pivotally attached to said upper end of said middle arm;

a boat top attached to each said upper end of each said upper arm of said first articulated frame member and said second articulated frame member;

wherein said first articulated frame member and second articulated frame member are each pivotable between an extended position wherein each said middle arm is substantially in line with each said base member and each said upper arm, and a retracted position wherein each said middle arm is substantially unaligned with respect to each said base member and each said upper arm.

7. The multi-positionable boat top assembly as described in claim 6 wherein each said base member comprises:

a first and second leg; and a base stabilizing rod connected between said first leg and said second leg.

8. The articulated boat top assembly as described in claim 6 further comprising:

a stabilizing shaft connecting said first articulated frame member with said second articulated frame member;

a first locking bar having an upper end and a lower end, said lower end of said first locking bar connected to said stabilizing shaft;

a second locking bar having an upper end and a lower end, said lower end of said second locking bar connected to said stabilizing shaft;

a first connecting cylinder extending from said middle arm of said first articulated frame member;

a second connecting cylinder extending from said middle arm of said second articulated frame member;

a first collar movably positioned around said first locking bar, said first collar connecting said first locking bar with said first connecting cylinder; and a second collar movably positioned around said second locking bar, said second collar connecting said second locking bar with said second connecting cylinder.

9. The multi-positionable boat top assembly as described in claim 7 further comprising at least one sleeve surrounding each said middle arm, wherein said sleeve is positionable between an unlocked position solely around said middle arm, and a locked position at least partially surrounding both said middle arm and one said leg of said base member.

10. The multi-positionable boat top assembly as described in claim 9 further comprising at least one gasket positioned between each said sleeve and each said corresponding middle arm.

11. An articulated boat top assembly mounted to a deck of a boat, said articulated boat top assembly comprising:

a first articulated frame member including:

a base member;

at least one middle arm having a first and second end, said second end of said middle arm pivotally attached to said base member; and at least one upper arm having a first and second end, said second end of said upper arm pivotally connected to said first end of said middle arm;

a second articulated frame member including:

a base member;

at least one middle arm having a first and second end, said second end of said middle arm pivotally attached to said base member; and at least one upper arm having a first and second end, said second end of said upper arm pivotally connected to said first end of said middle arm;

a stabilizing shaft connecting said first articulated frame member with said second articulated frame member;

a first locking bar having a proximal end and a distal end, said proximal end attached to said stabilizing shaft and said distal end detachably attached to said middle arm of said first articulated frame member;

a second locking bar having a proximal end and a distal end, said proximal end attached to said stabilizing shaft and said distal end detachably attached to said middle arm of said second articulated frame member;

wherein said first and second articulated frame members are pivotable between an extended position wherein each said middle arm is substantially in line with each said base member and each said upper arm, and a retracted position wherein each said middle arm is substantially perpendicular with respect to each said base member and each said upper arm.

* * * * *